US006017028A

United States Patent [19]

St. John et al.

[11] Patent Number: 6,017,028

[45] Date of Patent: Jan. 25, 2000

[54] HOPPER LOADER HAVING ARCED CONVEYOR FOR FORMING AN OVERLAPPING STREAM OF SIGNATURES FROM A VERTICAL STACK

[76] Inventors: John St. John, P.O. Box 3236, Blue Jay, Calif. 92317; Eduardo Salazar, 1939 Wright St., Pomona, Calif. 91766

[21] Appl. No.: 08/954,868

[22] Filed: Oct. 21, 1997

[51] Int. Cl.[7] ..... B65H 5/22

[52] U.S. Cl. ..... 271/3.01; 271/3.12; 271/3.13; 271/31.1; 271/150

[58] Field of Search ..... 271/3.01, 3.12, 271/3.13, 3.17, 31.1, 97, 149, 150, 161, 167, 169

[56] References Cited

U.S. PATENT DOCUMENTS

| | | | |
|---|---|---|---|
| 3,422,947 | 1/1969 | Kraft et al. | 198/16 |
| 3,741,413 | 6/1973 | Friel | 214/41 |
| 3,904,191 | 9/1975 | Maier, Jr. et al. | 271/150 |
| 3,945,633 | 3/1976 | Knopp | 271/3.1 |
| 3,945,635 | 3/1976 | Marin | 271/202 |
| 4,008,890 | 2/1977 | Pulda | 271/151 |
| 4,049,260 | 9/1977 | Szymborski | 271/151 |
| 4,396,112 | 8/1983 | Von Wietersheim et al. | 198/822 |
| 4,451,967 | 6/1984 | Stobb | 29/564.3 |
| 4,518,079 | 5/1985 | Paelke | 198/864 |
| 4,565,285 | 1/1986 | Koistinen | 198/819 |
| 4,588,180 | 5/1986 | Ballestrazzi et al. | 271/5 |
| 4,861,014 | 8/1989 | Martin | 271/198 |
| 4,869,486 | 9/1989 | Scarpa et al. | 271/150 X |
| 4,973,038 | 11/1990 | Curley et al. | 271/146 |
| 5,026,038 | 6/1991 | Weller et al. | 271/3.1 |
| 5,027,940 | 7/1991 | Woodward | 198/500 |
| 5,131,531 | 7/1992 | Chambers | 198/860 |
| 5,238,239 | 8/1993 | Lachapelle | 271/275 |
| 5,246,102 | 9/1993 | Rappen et al. | 198/860.2 |
| 5,282,613 | 2/1994 | Standerfer et al. | 271/202 |
| 5,360,102 | 11/1994 | Schoning | 198/831 |
| 5,380,148 | 1/1995 | Bates et al. | 414/798.2 |

FOREIGN PATENT DOCUMENTS

| | | | |
|---|---|---|---|
| 2404627 | 9/1974 | Germany . | |
| 2135978 | 9/1984 | United Kingdom | B65H 5/02 |

*Primary Examiner*—David H. Bollinger
*Attorney, Agent, or Firm*—Roberts & Mercanti, L.L.P.

[57] ABSTRACT

The invention pertains to a hopper loader apparatus for separating and forming an overlapping shingled stream of individual signatures of sheet materials from a vertically aligned, parallelepiped shaped stack of such signatures for subsequent handling operations. The hopper-loader has a chassis; a first continuous, downwardly inclined planar conveyor mounted on the chassis which moves a stack of vertically aligned signatures and deposits them onto a second conveyor as a separated, shingled stream of the signatures. The second conveyor is mounted on the chassis and aligned with an end of the first conveyor. It has a plurality of driven belts which travel over each of an upwardly inclined planar ramp segment, an arched transition segment, and a planar exit segment. The arched transition segment comprises either a belt slide or a plurality of serially arranged rollers.

22 Claims, 4 Drawing Sheets

HOPPER LOADER HAVING ARCED CONVEYOR FOR FORMING AN OVERLAPPING STREAM OF SIGNATURES FROM A VERTICAL STACK

BACKGROUND OF THE INVENTION

1. Field of the Invention

The invention pertains to a hopper loader apparatus for separating and forming an overlapping shingled stream of individual signatures of sheet materials from a vertically aligned, parallelepiped shaped stack of such signatures. The separated, individual signatures may then be subjected to subsequent handling operations.

2. Description of the Prior Art

It is usual in the graphic arts that sheet materials such as newspapers, books, printed cartons and the like emerge from a printing operation in a serial stream of partially overlapping signatures in shingled form. Such a stream of signatures is typically collected on a conveyor and moved to a stacker for aligning. The stacker receives the sheets in a serial mode from the conveyor and forms a neatly aligned stack for removal and transportation. While large numbers signatures can be conveniently handled in stack form, some operations on the signatures can only be performed individually. It therefore becomes necessary to separate individual signatures from a stack for individual treatment. The present invention pertains to a vertical hopper loader for separating individual signatures, which are substantially vertically aligned on a folded edge, from a stack of signatures and then forming an overlapping shingled stream of individual signatures.

It has been a problem in the art to provide an efficient and effective means of separating a stack into its individual signatures for presentation to other equipment, such as a packer box on a binder line. In the past, a stacked pile of printed signatures has been moved or pushed on a horizontal conveyor to an upwardly moving conveyor. Such an operation has many disadvantages since the stack does not reliably separate into evenly spaced overlapping individual signatures. This unevenness inevitably leads to downstream signature jams and misfeeds requiring considerable operator attention.

Complicated signature feeding equipment is known in the art. In this regard, U.S. Pat. No. 4,973,038 discloses a signature handling apparatus, however, this disclosure uses a horizontal feed conveyor which requires a stack pusher. The signatures tend to slide down a second ramp conveyor and hence require a retainer wedge. U.S. Pat. No. 4,049,260 shows an apparatus for feeding sheets having a horizontal entry conveyor and a ramp conveyor with an abrupt transition to an exit conveyor. U.S. Pat. No. 5,282,613 discloses a signature stream feeding apparatus which requires three conveyors. Likewise U.S. Pat. Nos. 4,008,890 and 3,945,633 discloses a signature stream feeding apparatus which requires three conveyors. Signatures moved by prior art three conveyor hopper loaders also have an abrupt transition between an upwardly directed ramp conveyor and a generally horizontal exit conveyor. As a result, they tend to follow a path propelled tangentially to the upwardly inclined ramp conveyor. This leads to an irregular signature stream. The complicated nature of the construction and mode of operation of known on-edge signature supply assemblies increases the probability of a jam or other malfunction during operation of the signature supply assemblies. In addition, the more complicated the construction of the signature supply assembly, the greater will be the cost of construction.

It has also been a problem in the art to reliably provide an efficient and effective means of separating a stack into its individual signatures and run reliably with a large range of signature sizes. The paper stock may range from heavyweight to lightweight and from a few pages per signature to many pages per signature. This difference in paper weight and/or pagination has required the operator to perform many adjustments to make the machine ready for a production run. The present invention seeks to simplify hopper loader construction, reduce costs and avoid or reduce problems encountered in the prior art. In prior art equipment, a stacked pile of printed signatures has been moved on a horizontal conveyor to an upwardly moving conveyor. Such an operation has many disadvantages since the stack does not reliably separate into evenly speed overlapping individual signatures which also leads to down stream signature jams and misfeeds. Difficulties in operating vertical loaders arise in that a large quantity of signatures cannot be loaded in the loader without interfering with the feeding of signature at the supply station, and the loaders cannot handle very short and very long signatures without substantial changes in the feeding mechanism. Further, the signatures are subjected to a constant riffling, sliding and jostling action that results in damage to the folds on the signatures when they move between conveyor belts. The present invention provides a vertical loader which avoids or reduces problems encountered in the prior art. The invention provides an apparatus for separating individual signatures which are substantially vertically aligned on a folded edge from a stack of signatures and then feeding them to subsequent processing equipment. According to the present invention there is provided a hopper loader which has only two conveyors, a downwardly inclined entry conveyor and an exit conveyor. The exit conveyor has an upwardly inclined planar ramp segment, an arched transition segment, and a planar exit segment. The arched transition segment has either a belt slide or a plurality of serially arranged rollers such that the arched transition segment has a radius of curvature sufficiently large such that a signature has a greater tendency to follow a path of the arched transition segment than to be propelled tangent to the upwardly inclined planar ramp segment. This smooth transition produces a regular, even signature stream. Individual signatures flow reliably, one-by-one downwardly out of the pocket to bindery equipment. The simplified equipment is economical, mobile, and signature size changeovers are easy to accomplish.

These and other features, advantages and improvements will be in part discussed and in part apparent to one skilled in the art upon a consideration of the detailed description of the preferred embodiment and the accompanying drawings.

SUMMARY OF THE INVENTION

The invention provides a hopper-loader which comprises:

a) chassis;

b) a first continuous, downwardly inclined planar conveyor mounted on the chassis; said first conveyor being capable of moving a parallelpiped shaped stack of vertically aligned signatures to a second conveyor and depositing a separated, shingled stream of the signatures onto the second conveyor; and c) a single, continuous, second conveyor mounted on the chassis and aligned with an end of the first conveyor; the second conveyor comprising a plurality of driven belts which travel over each of an upwardly inclined planar ramp segment, an arched transition segment, and a planar exit segment; the arched transition segment comprising either a belt slide or a plurality of serially arranged rollers.

The invention also provides a process for distributing a separated, shingled stream of the signatures from a parallelpiped shaped stack of vertically aligned signatures which comprises i) providing a hopper-loader which comprises:
   a) a chassis;
   b) a first continuous, downwardly inclined planar conveyor mounted on the chassis; said first conveyor being capable of moving a parallelpiped shaped stack of vertically aligned signatures to a second conveyor and depositing a separated, shingled stream of the signatures onto the second conveyor; and
   c) a single, continuous, second conveyor mounted on the chassis and aligned with an end of the first conveyor; the second conveyor comprising a plurality of driven belts which travel over each of an upwardly inclined planar ramp segment, an arched transition segment, and a planar exit segment; the arched transition segment comprising either a belt slide or a plurality of serially arranged rollers;

ii) placing a parallelpiped shaped stack of vertically aligned signatures onto the first conveyor;

iii) moving the parallelpiped shaped stack of vertically aligned signatures with the first conveyor and depositing a separated, shingled stream of the signatures onto the second conveyor.

DETAILED DESCRIPTION OF THE PREFERRED EMBODIMENT

Figure 1:
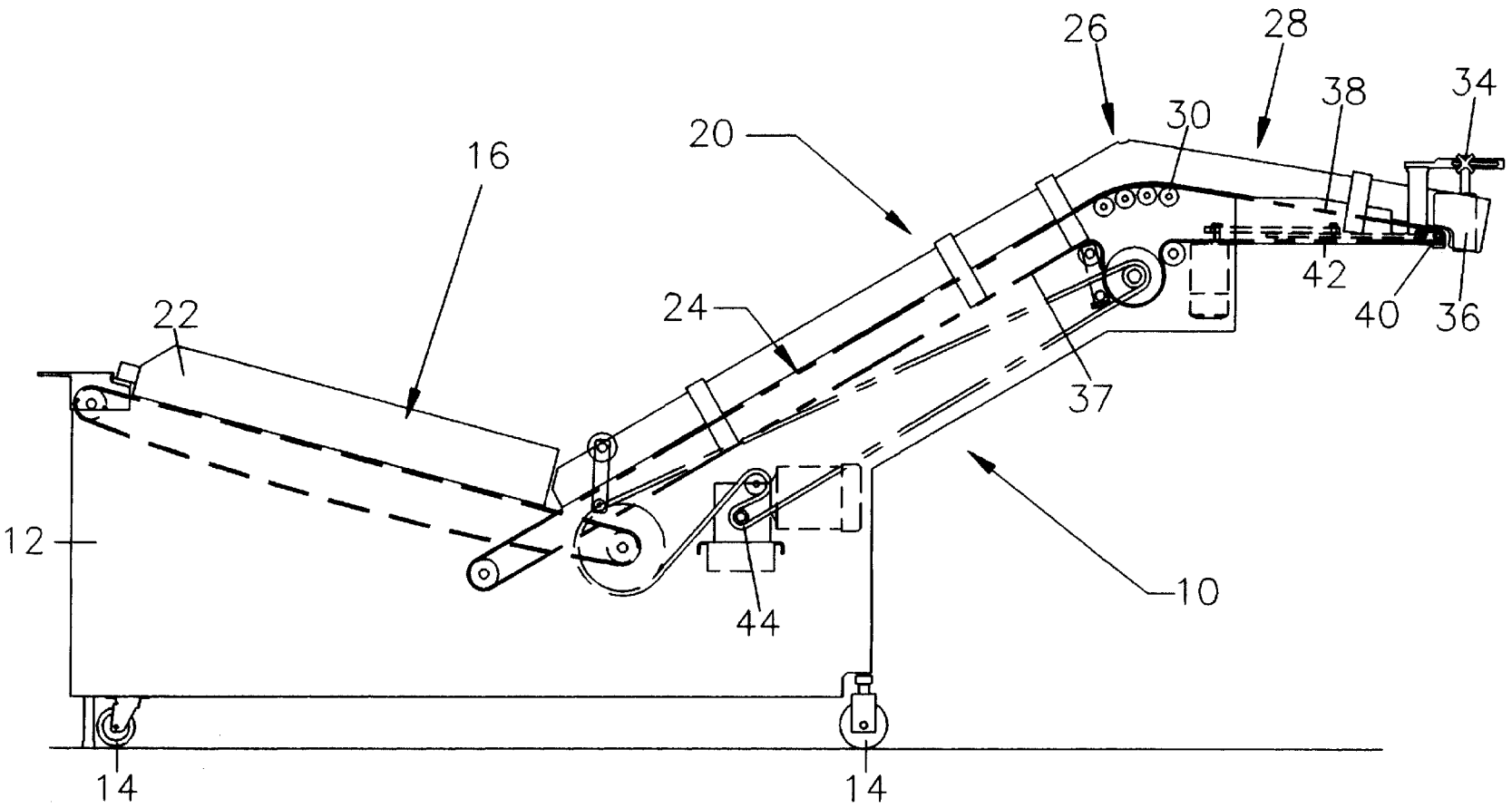
FIG. 1 shows a side view of the hopper loader according to the invention.
Figure 2:
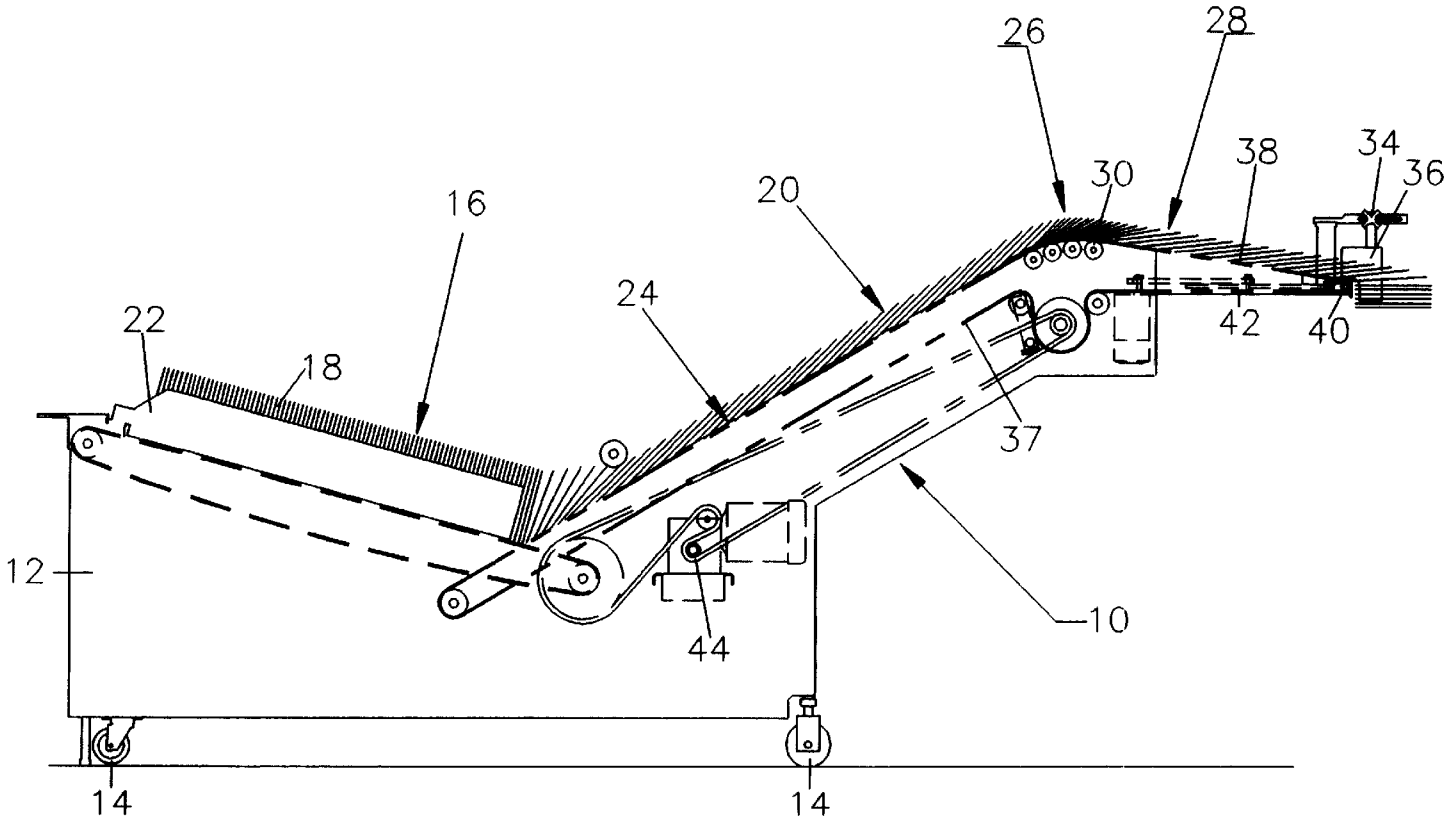
FIG. 2 shows a side view of a hopper loader according to the invention and further showing the movement path of signatures.

Referring to the drawings, FIGS. 1 and 2 show a hopper loader 10 according to the invention. It comprises a framework 12 which is movable by wheels 14. It has a first, downwardly inclined, planar conveyor 16 which preferably comprises a plurality of conveyor belts. In the preferred embodiment the belts are sturdy enough to move a relatively heavy stack of sheet signatures 18. As shown, the signatures are substantially vertically aligned and are in the form of a parallelepiped shaped stack. It is an important feature of the invention that the conveyor 16 be downwardly inclined. In the preferred embodiment, conveyor 16 has a downward decline measured from the horizontal of from about 10° to about 20°. This downward decline provides a gravity assist in the feeding of individual signatures from conveyor 16 to second upwardly inclined, planar conveyor section 20. In the preferred embodiment, the belts of the first conveyor are flat top chain belts and the second conveyor comprises a plurality of driven belts such that the belts of the first conveyor are aligned and interdigitated with the belts of the second conveyor.

The second conveyor 20 is capable of separating individual signatures from the stack on the first conveyor at an entry end of the second conveyor. Signatures fall over into an evenly overlapping shingled stream and travel up the second ramp conveyor as shown. In the preferred embodiment, the second conveyor has an upward incline measured from the horizontal of from about 25° to about 35°. An important feature of the invention is that an angle is formed between the first, downwardly inclined, planar conveyor and the second, upwardly inclined, planar conveyor which is from about 125° to about 145°. In addition, it is also important that the belts of the second conveyor belts travel at a speed which is faster than the belt speed of the first conveyor. In the preferred embodiment, the belt speed of the first conveyor ranges from about 1.1 feet/minute to about 7.1 feet per minute.

In the preferred embodiment, the belt speed of the second conveyor ranges from about 5.9 feet/minute to about 38.5 feet per minute. Most preferably the speed ratio of the second conveyor to the first conveyor is from about 3:1 to about 9:1. This combination of downward sloping first conveyor, upward sloping second conveyor, included angle of from about 125° to about 145° and speed differential gives a smooth, even transition from a stack of signatures to a thick shingled stream of even overlapping individual signatures.

The hopper loader configuration according to the invention, allows processing of a wide variety of sizes of signatures from thick multipage books to thin signatures having a very few pages. In the preferred embodiment, the signatures are supported down the first conveyor by a side guide 22.

As shown in FIG. 2, the stream of individual signatures travels up the incline of second conveyor in overlapping shingles fashion. The second conveyor comprises several integral, sequential segments, namely an upwardly inclined planar ramp segment 24, an arched transition segment 26, and a planar exit segment 28. The belts of the second conveyor move up ramp segment 24 and around the arched transition segment 26. The arched transition segment 26 comprises either a curved sheet metal slide over which the belts slide or a plurality of serially arranged rollers, such as 30. Preferably the arched transition segment comprises from about three to about five rollers, more preferably four rollers. The arched transition segment has a radius of curvature sufficiently large such that a signature moved by the second conveyor has a greater tendency to follow a path of the arched transition segment than to be propelled tangent to the upwardly inclined planar ramp segment. Preferably the arched transition segment has a radius of curvature of at least about 10 inches and more preferably from about 10 inches to about 15 inches.

Figure 3:
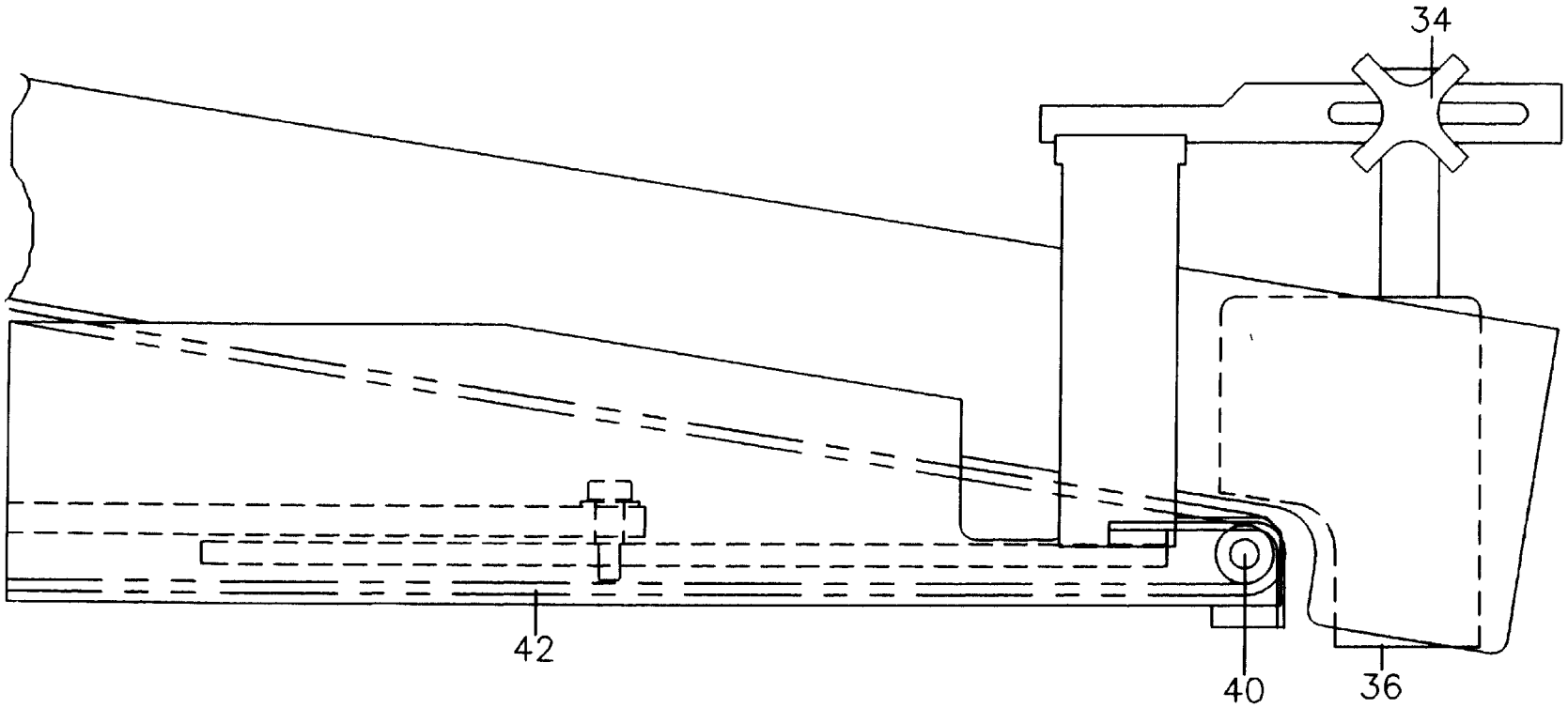
FIG. 3 shows a side view of the right side of the planar exit segment of the second conveyor showing signature pushers and a signature jogger.
Figure 4:
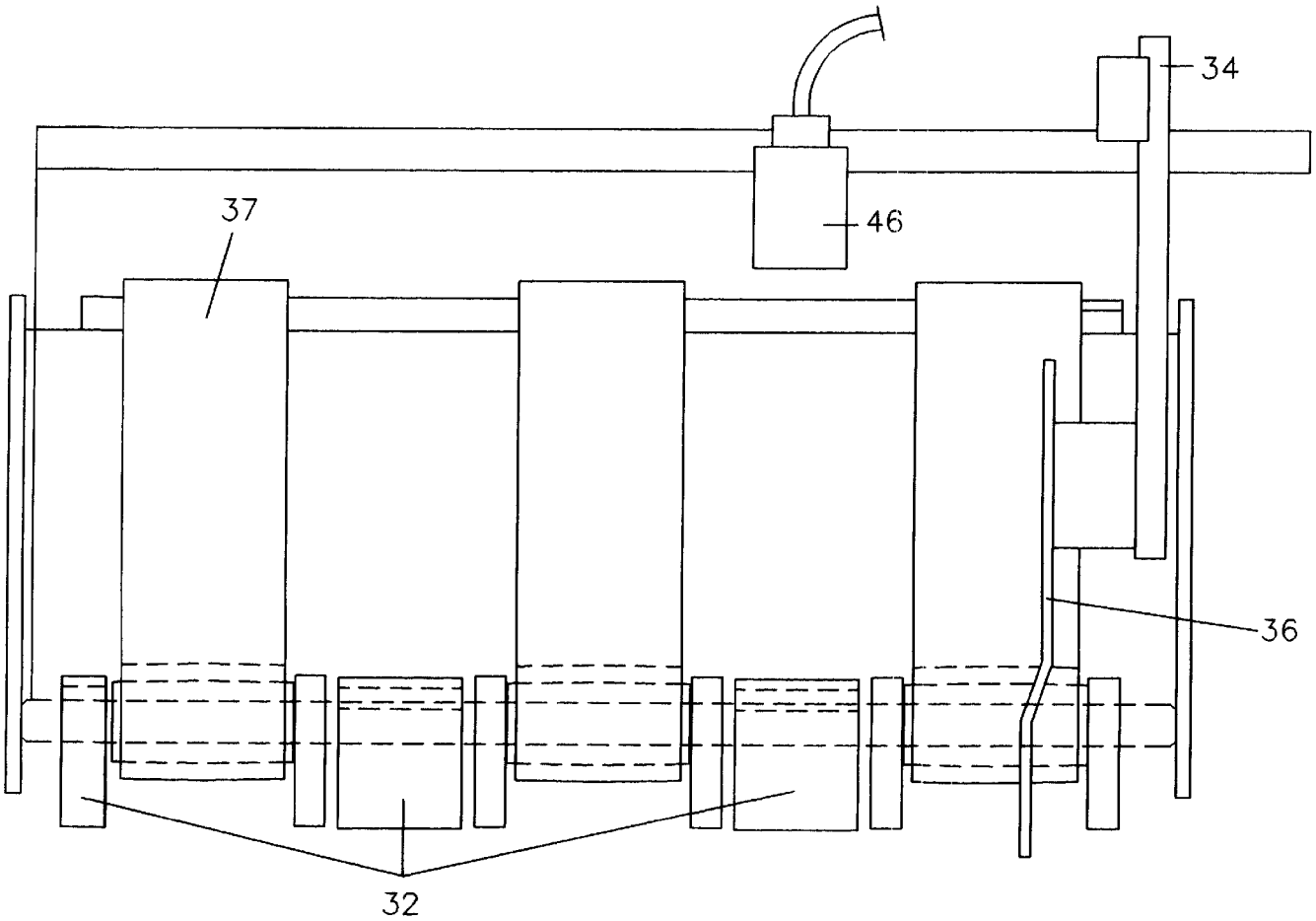
FIG. 4 shows a view of the front of the planar exit segment of the second conveyor showing signature pushers and a signature jogger.

The arched transition segment 26 progresses to planar exit segment 28. Preferably the planar exit segment of the second conveyor has a downward decline of from about 5° to about 20° measured from the horizontal. As shown in FIGS. 3 and 4 the planar exit segment of the second conveyor showing preferably has a plurality of reciprocating signature pushers such as L-shaped signature pushers 32 positioned between the belts 37, which push the signatures in a forward direction. Optionally, but preferably the planar exit segment of the second conveyor has a signature jogger 34, which aligns the signatures via jogger paddles 36 for exit from the second conveyor. The exit segment 28 preferably has a declining upper segment 38 terminating at a belt turnaround roller 40 which meets a substantially horizontal belt return segment 42. Preferably the turnaround roller has a diameter of about 3 inches or less. Preferably the angle between the upper segment and the return segment is in the range of about 10° or less. This gives a needle-nosed configuration which greatly assists in the precision placement of exiting signatures to subsequent processing equipment.

The movement of the first and second conveyors is accomplished by suitable drive means including motors, pulleys, belts and rollers shown generally at 44. It is understood that the provision of such suitable drive means is well within the ability of those skilled in the art.

In the preferred embodiment, the drive of the first conveyor and the second conveyor are controlled by a sensor 46 such as a photoelectric cell which is responsive to the presence or absence of a signature at a position.

What is claimed is:

1. A hopper-loader which comprises:

a) a chassis;

b) a first continuous, downwardly inclined planar conveyor mounted on the chassis; said first conveyor being capable of moving a parallelpiped shaped stack of vertically aligned signatures to a second conveyor and depositing a separated, shingled stream of the signatures onto the second conveyor; and c) a single, continuous, second conveyor mounted on the chassis and aligned with an end of the first conveyor; the second conveyor comprising a plurality of driven belts which travel over each of an upwardly inclined planar ramp segment, an arched transition segment, and a planar exit segment; the arched transition segment comprising either a belt slide or a plurality of serially arranged rollers.

2. The hopper loader of claim 1 wherein the chassis is transportable by means of wheels.

3. The hopper loader of claim 1 wherein the first conveyor has a downward decline of from about 10° to about 20° measured from the horizontal.

4. The hopper loader of claim 1 wherein the ramp segment of the second conveyor has an upward incline of from about 25° about 35° measured from the horizontal.

5. The hopper loader of claim 1 wherein the planar exit segment of the second conveyor has a downward decline.

6. The hopper loader of claim 1 wherein the planar exit segment of the second conveyor has a downward decline of from about 5° about 200° measured from the horizontal.

7. The hopper loader of claim 1 wherein the arched transition segment has a radius of curvature sufficiently large such that a signature moved by the second conveyor has a greater tendency to follow a path of the arched transition segment than to be propelled tangent to the upwardly inclined planar ramp segment.

8. The hopper loader of claim 1 wherein the arched transition segment has a radius of curvature of at least about 10 inches.

9. The hopper loader of claim 1 wherein the arched transition segment comprises from about three to about five rollers and has a radius of curvature of from about 10 inches to about 15 inches.

10. The hopper loader of claim 1 wherein the arched transition segment comprises from about three to about five rollers and has a radius of curvature of from about 10 inches to about 15 inches; wherein the ramp segment of the second conveyor has an upward incline of from about 25° about 35° measured from the horizontal; and wherein the planar exit segment of the second conveyor has a downward decline of from about 5° about 20° measured from the horizontal.

11. The hopper loader of claim 1 wherein the arched transition segment comprises from about three to about five rollers and has a radius of curvature of from about 10 inches to about 15 inches; wherein the first conveyor has a downward decline of about 10° to about 20° measured from the horizontal; wherein the ramp segment of the second conveyor has an upward incline of from about 25° about 35° measured from the horizontal; wherein the planar exit segment of the second conveyor has a downward decline of from about 5° about 20° measured from the horizontal.

12. The hopper loader of claim 1 wherein the first conveyor comprises a plurality of driven flat top chain belts and the second conveyor comprises a plurality of driven belts such that the belts of the first conveyor are interdigitated with the belts of the second conveyor.

13. The hopper loader of claim 12 wherein the exit segment comprises a plurality of reciprocating signature pushers positioned between the belts of the second conveyor which push the signatures in a forward direction.

14. The hopper loader of claim 12 wherein the exit segment has a declining upper segment terminating at a belt turnaround roller which meets a substantially horizontal belt return segment, wherein the angle between the upper segment and the return segment is in the range of about 10° or less.

15. The hopper loader of claim 14 wherein the belt turnaround roller has a diameter of about 3 inches or less.

16. The hopper loader of claim 12 wherein the drive of the first conveyor and the second conveyor are controlled by a photoelectric cell responsive to the presence or absence of a signature at a position.

17. The hopper loader of claim 1 further comprising a signature side jogger positioned at the exit segment.

18. The hopper loader of claim 1 wherein the arched transition segment comprises from about three to about five rollers and has a radius of curvature of from about 10 inches to about 15 inches; wherein the first conveyor has a downward decline of about 10° to about 20° measured from the horizontal; wherein the ramp segment of the second conveyor has an upward incline of from about 25° about 35° measured from the horizontal; wherein the planar exit segment of the second conveyor has a downward decline of from about 5° about 20° measured from the horizontal; wherein the first conveyor comprises a plurality of driven flat top chain belts and the second conveyor comprises a plurality of driven belts such that the belts of the first conveyor are interdigitated with the belts of the second conveyor; wherein the exit segment has a declining upper segment terminating at a belt turnaround roller which meets a substantially horizontal belt return segment, wherein the angle between the upper segment and the return segment is in the range of about 10° or less; wherein the exit segment comprises a plurality of reciprocating signature pushers positioned between the belts which push the signatures in a forward direction; wherein the drive of the first conveyor and the second conveyor are controlled by a photoelectric cell responsive to the presence or absence of a signature at a position; further comprising a signature side jogger positioned at the exit segment.

19. The hopper loader of claim 1 wherein the arched transition segment comprises four rollers and has a radius of curvature of about 12 inches; wherein the first conveyor has a downward decline of about 10° to about 20° measured from the horizontal, wherein the ramp segment of the second conveyor has an upward incline of about 25° to about 35° measured from the horizontal and wherein the exit segment of the second conveyor has a downward decline of from about 5° to about 20° measured from the horizontal; wherein the first conveyor comprises a plurality of driven flat top chain belts and the second conveyor comprises a plurality of driven belts such that the belts of the first conveyor are interdigitated with the belts of the second conveyor; wherein the exit segment has a declining upper segment terminating at a belt turnaround roller which meets a substantially horizontal belt return segment, wherein the angle between the upper segment and the return segment is in the range of about 10° or less; wherein the exit segment comprises a plurality of substantially L-shaped reciprocating signature pushers positioned between the belts which push the signatures in a forward direction; wherein the drive of the first conveyor and the second conveyor are controlled by a photoelectric cell responsive to the presence or absence of a signature at a position; further comprising a signature side jogger positioned at the exit segment.

20. A process for distributing a separated, shingled stream of the signatures from a parallelpiped shaped stack of vertically aligned signatures which comprises i) providing a hopper-loader which comprises:

a) a chassis;

b) a first continuous, downwardly inclined planar conveyor mounted on the chassis; said first conveyor being capable of moving a parallelpiped shaped stack of vertically aligned signatures to a second conveyor and depositing a separated, shingled stream of the signatures onto the second conveyor; and c) a single, continuous, second conveyor mounted on the chassis and aligned with an end of the first conveyor; the second conveyor comprising a plurality of driven belts which travel over each of an upwardly inclined planar ramp segment, an arched transition segment, and a planar exit segment; the arched transition segment comprising either a belt slide or a plurality of serially arranged rollers;

ii) placing a parallelpiped shaped stack of vertically aligned signatures onto the first conveyor;

iii) moving the parallelpiped shaped stack of vertically aligned signatures with the first conveyor and depositing a separated, shingled stream of the signatures onto the second conveyor.

21. The process of claim 20 wherein a speed ratio of the first conveyor to the second conveyor is from about 3:1 to about 9:1.

22. The process of claim 20 wherein the arched transition segment comprises from about three to about five rollers and has a radius of curvature of from about 10 inches to about 15 inches; wherein the first conveyor has a downward decline of about 10° to about 20° measured from the horizontal, wherein the ramp segment of the second conveyor has an upward incline of about 25° to about 350° measured from the horizontal and wherein the exit segment of the second conveyor has a downward decline of from about 5° to about 20° measured from the horizontal, wherein the first conveyor comprises a plurality of driven flat top chain belts and the second conveyor comprises a plurality of driven belts such that the belts of the first conveyor are interdigitated with the belts of the second conveyor; wherein the exit segment has a declining upper segment terminating at a belt turnaround roller which meets a substantially horizontal belt return segment, wherein the angle between the upper segment and the return segment is in the range of about 10° or less; wherein the exit segment comprises a plurality of reciprocating signature pushers positioned between the belts which push the signatures in a forward direction; wherein the drive of the first conveyor and the second conveyor are controlled by a photoelectric cell responsive to the presence or absence of a signature at a position; further comprising a signature side jogger positioned at the exit segment.

* * * * *